United States Patent [19]

Allread et al.

[11] 4,190,097

[45] Feb. 26, 1980

[54] APPARATUS FOR MAKING FOUNDRY CORES

[75] Inventors: John J. Allread, Hartland; Thomas A. McManamy, Reedsburg; Bruno E. Peter, Brookfield, all of Wis.

[73] Assignee: Grede Foundries Inc., Milwaukee, Wis.

[21] Appl. No.: 854,420

[22] Filed: Nov. 23, 1977

[51] Int. Cl.[2] ..... B22C 15/24

[52] U.S. Cl. ..... 164/343; 164/16

[58] Field of Search ..... 164/16, 306, 343, 119, 164/136, 165, 168, 342, 303, 12, 186, 187, 192

[56] References Cited

U.S. PATENT DOCUMENTS

| | | | |
|---|---|---|---|
| 2,991,506 | 7/1961 | Crandall | 425/236 X |
| 3,038,221 | 6/1962 | Hansberg | 164/16 X |
| 3,147,519 | 9/1964 | Hilliard | 164/165 |
| 3,296,665 | 1/1967 | Fenzan | 164/343 |
| 3,482,619 | 12/1969 | Hulslander | 164/186 X |
| 3,528,481 | 9/1970 | Lund | 164/16 X |

FOREIGN PATENT DOCUMENTS

| | | | |
|---|---|---|---|
| 874885 | 7/1971 | Canada | 164/303 |

*Primary Examiner*—Richard B. Lazarus
*Assistant Examiner*—John S. Brown
*Attorney, Agent, or Firm*—Andrus, Sceales, Starke & Sawall

[57] ABSTRACT

An apparatus for making foundry cores. A pair of support plates, each of which carries a core box half, are mounted on carriages and the carriages are movable toward and away from each other to bring the core box halves into mating relation. Mounted above the support plates is a reciprocating carriage that carries a sand head and a gas head. The carriage is initially positioned to locate the sand head beneath a hopper where the head is filled with sand impregnated with an uncured resin binder, and the carriage is then shifted to position the sand head over the core box and the sand is blown into the core box. The carriage is then returned to its original position so that the gas head is positioned over the core box, and a gas, which serves as a catalyst for the resin binder, is introduced into the core box to cure the resin. A manifold system is incorporated in the support plates so that the gas discharged from the core box is passed through a scrubber before being discharged to the atmosphere.

4 Claims, 8 Drawing Figures

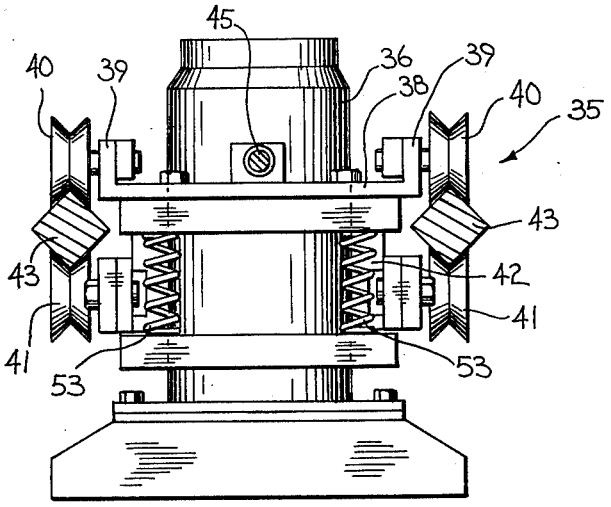
Fig. 5
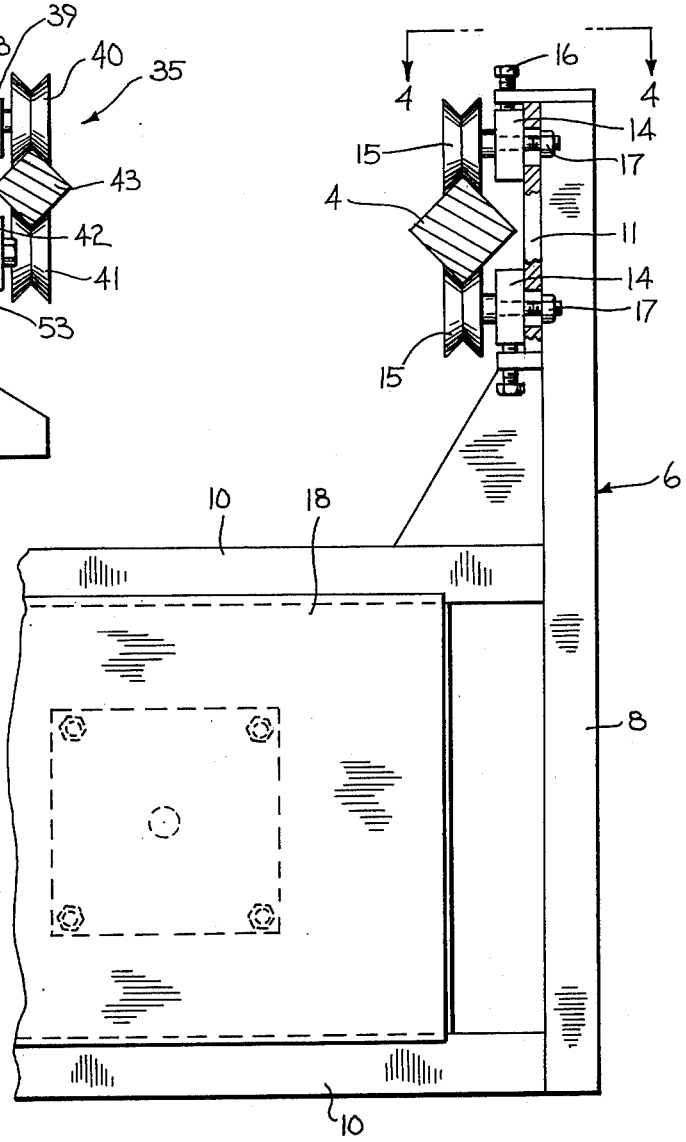
Fig. 3
Fig. 6
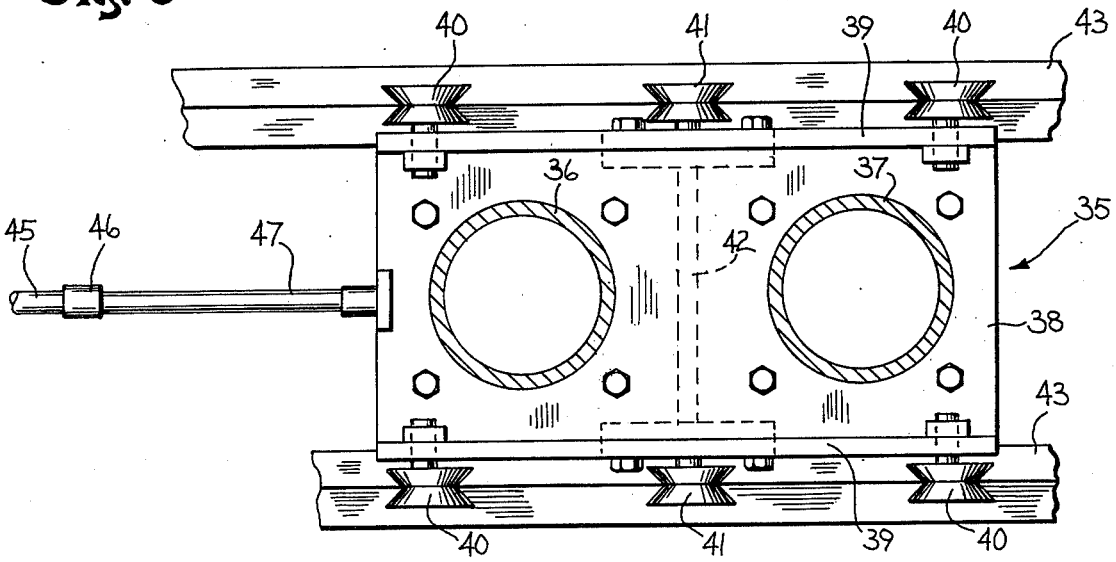

APPARATUS FOR MAKING FOUNDRY CORES

BACKGROUND OF THE INVENTION

Traditionally, foundry cores have been produced by manually introducing sand impregnated with a core oil into the core box. After tamping, the cores are removed from the box and placed in an oven to cure the core oil. This method system of producing cores requires considerable time, and the cycle normally takes approximately two hours from the time the sand is initially placed in the core box until the core is removed from the oven. As a further disadvantage, the method is limited to less complex shapes or configurations, and in many instances wires are required to be embedded within the sand to maintain the configuration when the core is initially removed from the core box. Because of the oven heating, the system has a high energy requirement.

Automated methods for producing cores, known in the trade as "hot boxes", have also been used in the past. In the "hot box" method, sand impregnated with a heat curable resin is blown into the core box which is mounted on the machine. Subsequently, the core box is heated by gas fired burners to cure the resin binder and produce the core. While the "hot box" substantially reduces the cycling time for producing a core, over that of the previously described manual method, the "hot box" has a high energy requirement, and the intense heating causes worker discomfort, as well as possible distortion of the core.

More recently, a "cold box" system of producing foundry cores has been employed, in which the core box is charged with sand containing a resin binder that is cured through use of a catalyst gas. With the "cold box" method no heating of the core is required so that the system has extremely low energy requirements. However, the "cold box" systems that have been used in the past have had certain operational difficulties. As an example, the core box halves have been mounted on support plates which in turn are mounted for movement on fixed guide rods. The core box halves are normally lifted by use of a crane or hoist during installation of the core box halves to the support plates, and occasionally the guide rods may be damaged or bent as the core box halves are swung into position, with the result that the support plates cannot properly move between the open and closed position. The core box halves, when installed, may also be swung into contact with either the sand or gas head, resulting in damage to these structures.

SUMMARY OF THE INVENTION

The invention relates to an improved apparatus for making foundry cores utilizing a catalyst gas to cure the resin binder for the core. In accordance with the invention, a pair of support plates, each of which carries a core box half, are mounted through manifold plates to reciprocating carriages. Pneumatic cylinders are connected to the carriages and act to move the core box halves between open and closed positions.

Mounted above the core box is a reciprocating carriage that carries a sand head and a gas head. To initiate the cycle, the sand head is located beneath a sand hopper and sand impregnated with an uncured resin binder is introduced into the sand head. After the sand head is filled, the carriage is then shifted to position the sand head over the core box and the sand is then blown into the box. The carriage is then returned to its original position, with the gas head being positioned over the core box, and a catalyst gas is introduced into the core box to cure the resin binder and produce the core.

The apparatus of the invention incorporates a manifold system in each manifold plate so that the catalyst gas discharged from the core box is passed through a scrubber before being discharged to the atmosphere.

The carriages that support the manifold plates for the core box halves are provided with a series of rollers that ride on tracks mounted on the frame or supporting structure. Adjustments are provided for the rollers so that a smooth rolling action is provided for the plates and core box halves as they are moved between the open and closed positions. Similarly, the carriage that supports the sand head and gas head is also provided with rollers which ride on a secondary track mounted on the frame of the machine.

As the apparatus of the invention does not require heating to cure the resin binder, the energy requirements are very low as compared to "hot box" systems or systems utilizing an oven cure.

Through the use of the reciprocating carriage, a shortened time cycle is achieved in which a 20 pound core can be produced in a period of less than 30 seconds and generally in a period of about 15 seconds. This operation cycle is substantially less than that of prior systems.

As the catalyst gas discharged from the core box is contained and piped to a scrubber unit system, the size and capability of the exhaust system is reduced over conventional designs in which the entire environmental atmosphere is exhausted and treated.

Other objects and advantages will appear in the course of the following description.

DESCRIPTION OF THE DRAWINGS

The drawings illustrate the best mode presently contemplated of carrying out the invention.

In the drawings:

FIG. 3 is a section taken along line 3—3 of FIG. 1;

FIG. 5 is a section taken along line 5—5 of FIG. 1;

FIG. 6 is a section taken along line 6—6 of FIG. 1;

DESCRIPTION OF THE PREFERRED EMBODIMENT

Figure 1:
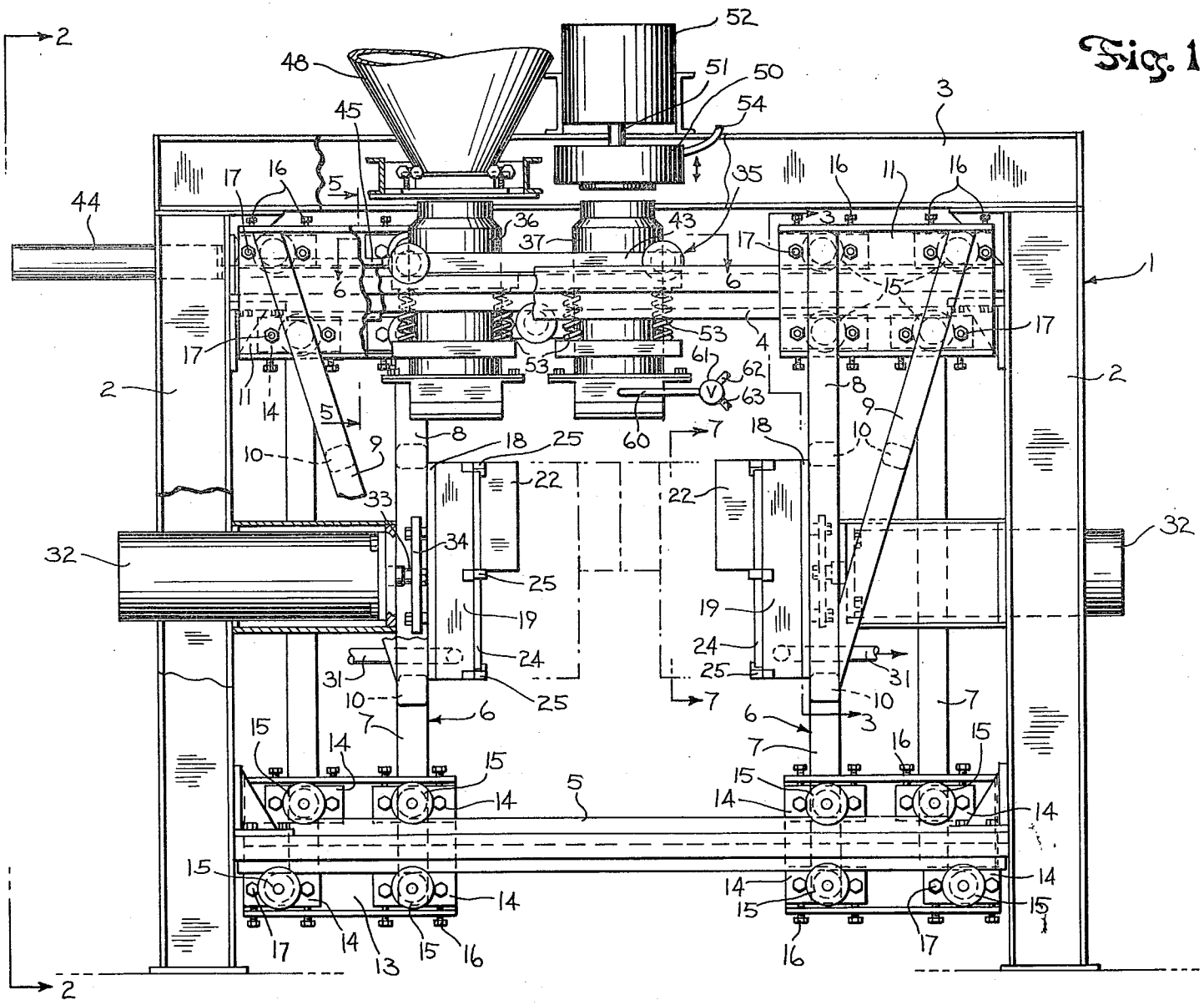
FIG. 1 is a front elevational view of the appartus of the invention, with parts broken away.
Figure 2:
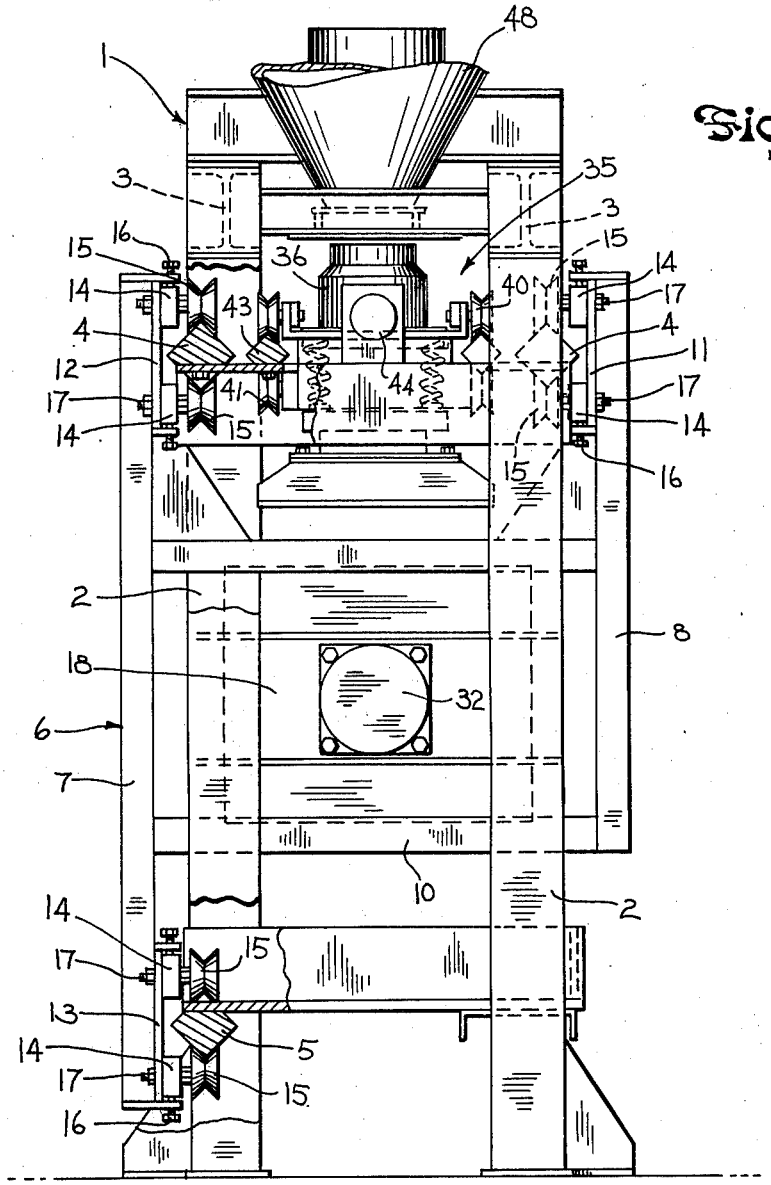
FIG. 2 is a side elevation of the apparatus of FIG. 1, with parts broken away.
Figure 4:
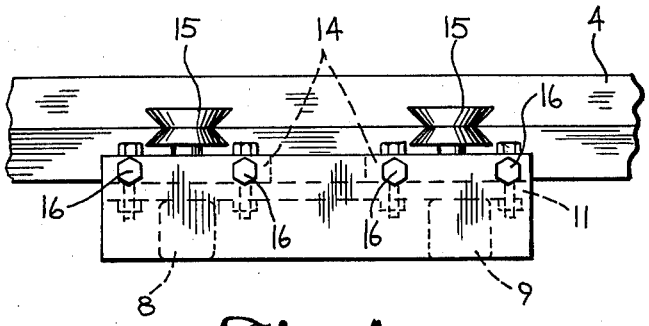
FIG. 4 is a view taken along line 4—4 of FIG. 3.

The drawings illustrate an apparatus for making foundry cores by a catalyst gas system. The apparatus includes a frame or supporting structure 1, composed of a series of vertical columns 2, which are connected at their upper ends by cross beams 3. A pair of upper rails 4 are connected between columns 2, and a lower rail 5 is secured between the lower ends of a pair of columns 2. As illustrated in FIG. 1, the rails 4 and 5 have a generally square cross section.

Mounted for travel on rails 4 and 5 are a pair of carriages 6, each of which is composed of a pair of rear vertical columns 7, a front vertical column 8 and a front diagonal column 9. The rear columns 7 have a longer length than front columns 8, and horizontal beams 10 connect the lower end of column 8 to column 7, as well as the central portions of columns 8 and 9 with rear columns 7.

To mount each carriage 6 for movement on rails 4 and 5, each carriage 6 includes a pair of upper mounting plates 11 and 12 and a lower plate 13. Mounting plate 11 is secured to the upper ends of front columns 8 and 9, while plates 12 and 13 are carried by the rear columns 7. Blocks 14 are mounted on each of the plates 11, 12 and 13, and rollers 15 are journalled for rotation on the respective blocks. As best shown in FIG. 1, a pair of rollers 15 associated with each mounting plate is adapted to ride on the upper surfaces of the respective rails 4 and 5, while a second pair of rollers associated with each plate is adapted to engage the lower surfaces of the respective rails.

To provide an adjustment for alignment and wear, the blocks 14, which carry the rollers 15, can be adjusted vertically by means of adjusting studs 16 which are threaded in flanges on the respective columns 7, 8, and 9 and engage the edges of the blocks. The bolts 17 which connect blocks 14 to the mounting plates extend through slotted openings in the plates to permit the vertical adjustment of the blocks 14, as best shown in FIG. 3.

Each carriage 6 carries a vertical support plate 18 which is positioned in a front-to-rear direction and is secured to beams 10.

Figure 8:
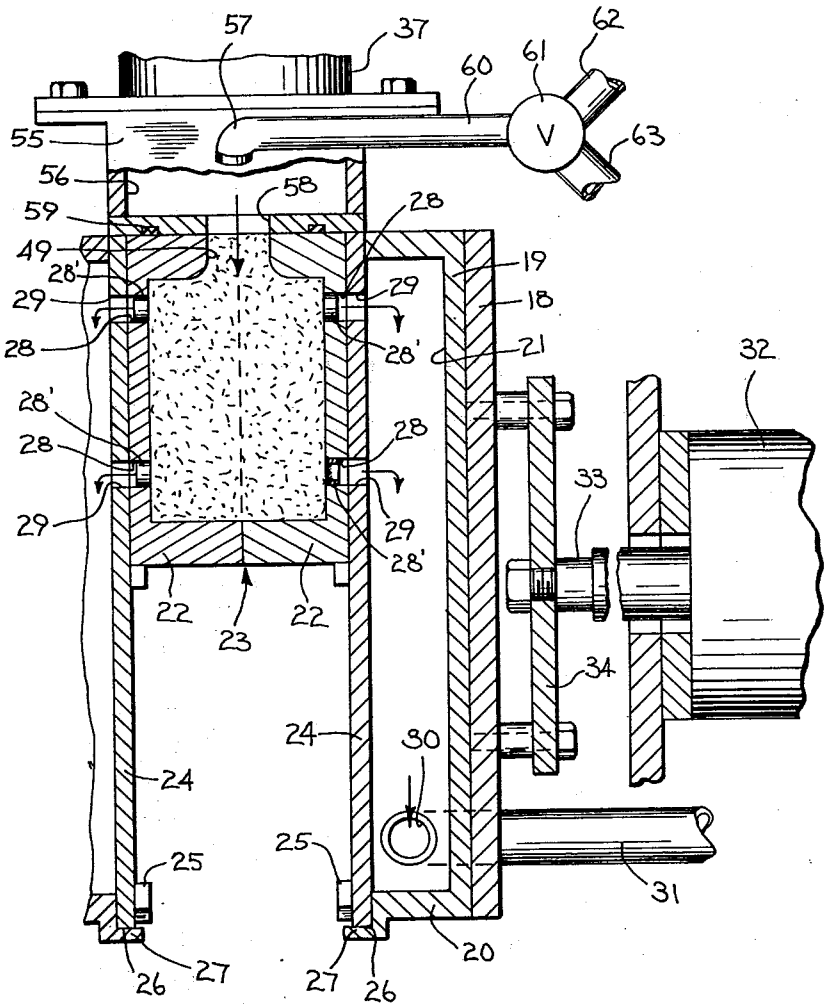
FIG. 8 is a vertical section showing the core box and gas head.
Figure 7:
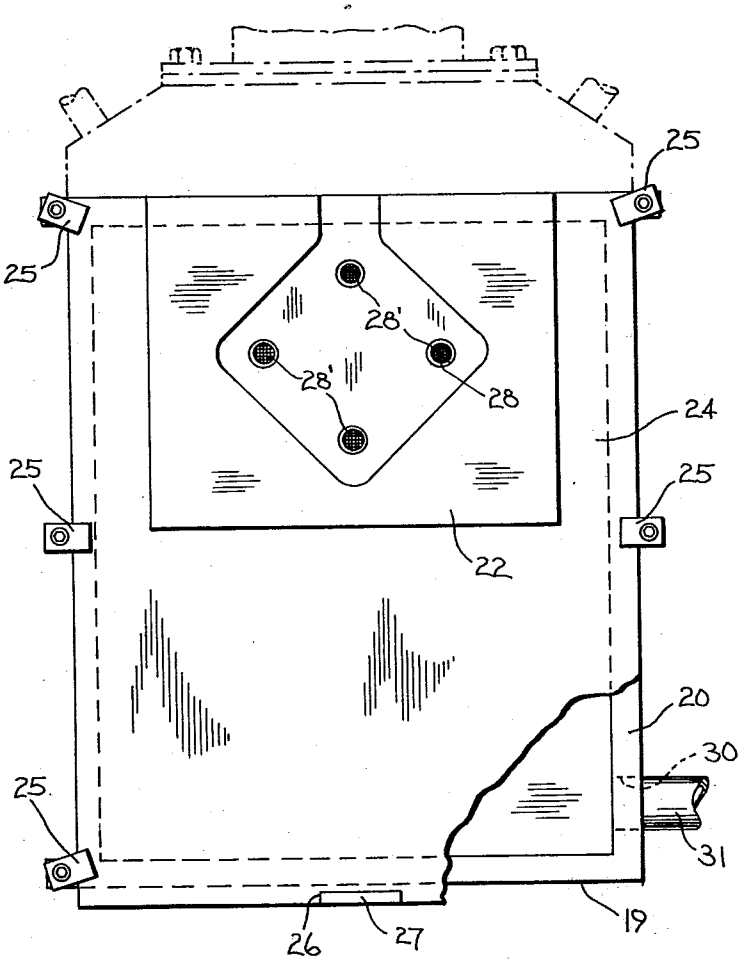
FIG. 7 is a view taken along line 7—7 of FIG. 1.

As shown in FIG. 8, a manifold plate 19 is mounted flatwise on each plate 18 and each manifold plate is provided with an upstanding peripheral flange 20 which borders a central recess or depression 21. Core box halves 22 are adapted to be mounted on the manifold plates 19 and through movement of carriages 6, the core box halves can be brought into mating relation to form the core box 23.

To facilitate installation of the core box halves 22, a plate 24 is permanently secured to each core box half and is mounted on the flange 20 of manifold plate 19 by a series of clips 25. To properly align the core box half 22 and with the manifold plate 19, the plate 24 is provided with a notch 26 in its lower edge which engages a projection 27 formed on the manifold plate 19.

Each core box half 22 is provided with a series of openings 28, enclosed by screens 28', and openings 28 are aligned with similar openings 29 in plate 24. The aligned openings communicate with the central recess 21 of manifold plate 19. The pattern and size of the openings 28 and 29 will depend primarily on the configuration of the core being produced.

Located in manifold plate 19 is an outlet opening 30 which is connected through conduit 31 to a conventional gas scrubbing unit. The catalyst gas used to cure the resin binder is discharged through the openings 28 and 29 into the recess 21 of the manifold plate and is then conducted through outlet 30 and conduit 31 to the scrubber. With this system, the catalyst gas is not discharged directly to the atmosphere so that the size and capability of the scrubbing unit is reduced over that of a system in which the entire environmental atmosphere is cycled through a scrubber.

The core box sections 22 can be provided with a plurality of standard ejection pins, not shown, that are utilized to eject the finished core from the core box, after the cycle is completed.

The core box halves 22 are moved toward and away from each other through pneymatic cylinders 32 which are mounted on the frame 1. As illustrated in FIG. 8, the piston rod 33 of each cylinder 32 is connected to a plate 34, which in turn is secured to support plate 18, and by extending the rods 32 the plates 18 along with the core box halves 22 will be moved to a closed position.

Mounted for reciprocating travel at a level above the core box 23 is a carriage 35 which carries a sand head 36 and a gas head 37. As best shown in FIGS. 5 and 6, the carriage 35 includes a generally horizontal plate 38 having a pair of upstanding side flanges 39, and a pair of rollers 40 are journalled for rotation on each side flange. In addition to rollers 40, a pair of rollers 41 are journalled on the lower end of a transverse vertical plate 42 which extends downwardly from plate 38 and is located generally centrally of the plate 38.

The upper rollers 40 are adapted to ride on the upper surface of rails 43 which are mounted on frame 1, while rollers 41 engage the lower surfaces of the rails 43. As shwon in FIG. 5, the rails 43 have a generally square cross section, being similar to rails 4 and 5.

To move the carriage 35 and the attached sand head 36 and gas head 37 in a reciprocating path, an air cylinder 44 is mounted on the frame 1 and the piston rod 45 of the cylinder is coupled through a quick release coupling 46 to a stub shaft 47 mounted on the plate 38. With this construction, extension and retraction of the piston rod 45 will move the carriage 35 along the rails 43 to selectively position the sand head 36 or the gas head 37 above the core box 23.

Mounted above the carriage 35 is a hopper 48 which contains sand coated with a resin that can be cured by exposure to a catalyst gas. The particular resin and catalyst gas are known in the art and, in themselves, form no part of the invention. The resin can be a two part system composed of a phenolformaldehyde resin and an isocyanate polymer, while the catalyst gas can be dimethylethylamine.

When the carriage 35 is moved through operation of cylinder 44 to the left, as shown in FIG. 1, the sand head 36 will be positioned beneath the hopper 48 and a predetermined charge of sand is introduced into the sand head by operation of a conventional valve mechanism located in the bottom of hopper. When the sand head 36 is alinged with hopper 48, the gas head 37 is located in vertical alignment with the core box 23.

After the sand head 33 has been filled with resin coated sand, the carriage 35 is shifted through operation of the cylinder 44 to move the sand head 36 to a position over the core box 23. In this position, the sand head is aligned with the opening 49 in the upper end of the core box.

To introduce the sand into the core box, a blow valve mechanism 50, best shown in FIG. 1, and carried by the piston rod 51 of cylinder 52, is lowered into engagement with the upper end of the sand head 36, forcing the head downwardly, against the force of springs 53, into sealing engagement with the core box. With the sand head 36 sealed against the upper surface of the core box 23, a valve, not shown, in the sand head is opened, and air is introduced into the blow valve mechanism 50 through line 54, to thereby blow the sand from the sand head into the core box. The specific construction of the hopper 48, blow valve mechanism 50 and the sand head 36 is conventional, and does not, in itself, form a part of the present invention.

After the core box 13 has been filled with sand, the carriage 35 is again shifted to position the gas head 37 over the core box. As shown in FIG. 8, the gas head includes a bottom section 55 having a central cavity 56 and an inlet opening 57 and an outlet opening 58 communicate with the central cavity. A sealing ring 59 is mounted in the lower surface of section 55, and when the gas head 37 is forced downwardly through the action of the cylinder 52, the ring 59 will seal against the upper surface of the core box 23 and the outlet opening 58 will communicate with the opening 49 in the core box.

Inlet opening 57 is connected through line 60 to a 3-way valve 60, and a catalyst gas line 62 and an air line 63 are also connected to the valve. By connecting gas line 62 with line 60 through operation of valve 61, the catalyst gas will be introduced through the gas head 37 to the core box 23. After a predetermined time period sufficient to cure the resin, the flow of the catalyst gas is terminated by operation of valve 61, and the air line 63 is connected to the inlet 57 to thereby purge the core box with air. As previously noted, the exhaust gases pass through the manifold plate 19 and conduit 31 to a scrubbing mechanism.

OPERATION

The core box halves 22 are permanently attached to the plates 24, and the plates 24 carrying the core box halves are lifted by a fork lift truck or hoist and are attached to the respective manifold plates 19 through clips 25. As the unit includes only a single lower guide rail 5 located at the rear of the unit, the plates 24 can be readily moved into position without danger of striking, and possibly damaging, the rail 5. As previously noted, the notch 26 in the lower edge of plate 24 engages projection 27 on the manifold plate 19 to properly align the core box half with respect to the plate 18.

With the core box halves 22 properly mounted, the cylinders 32 are operated to move the carriages 6 and bring the core box halves 22 into mating engagement to form the core box 23.

The sand head 36 which is filled with the resin-coated sand, is then shifted to a position directly over the core box. Cylinder 52 is operated to seal the lower end of the sand head against the core box, and air is introduced to the flow valve mechanism 50 through line 54 to thereby blow the sand into the core box.

Following this, the piston 45 is retracted and the carriage 35 is shifted to position the gas head 37 over the core box 23. Again, the cylinder 52 is actuated to seal the bottom plate 55 of the gas head against the core box, and the inlet opening 57 is then connected through valve 61 to gas line 62 to introduce the catalyst gas into the core box to cure the resin. After a period of several seconds, the valve 61 is operated to connect air line 62 to inlet 57 to thereby introduce air into the core box and purge the gas.

Cylinder 52 is then operated to retract the piston rod 51, and cylinders 32 are actuated to open the core box, so that the core can be removed.

When the gas head 37 is positioned over the core box 23, the sand head 36 will be positioned beneath the hopper 48 so that a charge of sand will be introduced into the sand head while the core box is being purged with gas.

The system of the invention does not require heating to cure the resin binder and therefore substantially reduces the energy requirements over the traditional oven heating or "hot box" type of core making.

Due to the regulator system and the piping employed, the apparatus of the invention uses relatively low pressure gas, in the range of about 9 psig, as compared with about 15 psig used in conventional "cold box" systems. The reduction in pressure substantially reduces the catalyst gas consumption due to the fact that the gas is introduced into the core box for only a few seconds.

The positioning of the valve 60 adjacent the gas head 37 further reduces gas consumption in that it is not necessary to purge the catalyst gas from a long length of tubing after the end of each cycle.

The system of the invention utilizes air pressure of about 35 psig for blowing the sand into the core box, as compared to a pressure of 55 psig to 60 psig in conventional "cold box" systems. This reduction in air pressure results in less abrasive wear on the core box, and reduces the tendency of the air to blast the resin coating off the sand particles. Blasting of the resin coating from the sand particles, not only reduces the binding effect, but also results in a build-up of resin on the internal surfaces of the core box.

As a further feature of the invention, a quick disconnect coupling 46 is employed between the piston rod 45 of cylinder 44 and the carriage 35. By disconnecting the coupling 46, the carriage can be moved completely to the side during the installation or removal of the core box halves, so that the sand head 36 and gas head 37 will not interfere with the installation of the core box halves as they are lifted into position by a hoist or fork lift truck.

Because the carriages 6 and 35 are guided in movement by rollers riding on rails, smooth and uniform movement is insured, without a problem of jamming. The rollers can be adjusted in position relative to the tracks or rails, so that proper alignment can be obtained at all times.

Various modes of carrying out the invention are contemplated as being within the scope of the following claims particularly pointing out and distinctly claiming the subject matter which is regarded as the invention.

We claim:

1. An apparatus for producing foundry cores, comprising a frame, a plurality of generally parallel guide rails mounted on the frame, a pair of carriages, a plurality of rollers on each carriage, said rollers mounted for movement on said guide rails, a core box section mounted on each carriage, said guide rails include a pair of upper guide rails located at the front and rear of the apparatus respectively, and a single lower guide rail disposed at the rear of the apparatus, power means connected to each carriage to move the carriages in a direction toward and away from each other, moving said carriages toward each other bringing said core box sections into mating relation to form a core box, means for introducing sand coated with an uncured resin capable of being cured by a catalyst gas into said core box, and means for passing a cayalyst gas through said sand to cure the resin and provide the core.

2. The apparatus of claim 1, wherein said guide rails are generally rectangular in shape and the peripheral surfaces of said rollers are grooved to complement the rectangular shape of said rails.

3. The apparatus of claim 1, and including a pair of second rails mounted on the upper portion of the frame, a second carriage mounted for movement on said second rails, a sand head to contain the sand and carried by the second carriage, a gas head connected to a source of said catalyst gas and carried by said second carriage, and means to shift the second carriage in a linear path whereby the sand head can be positioned over the core box to introduce a charge of sand into said core box and said gas head can be moved to a position over said core box to introduce said gas into said core box.

4. The apparatus of claim 3, wherein said second carriage is provided with a plurality of rollers which ride on said second rails.

* * * * *